US007596108B2

(12) United States Patent
Olexa et al.

(10) Patent No.: US 7,596,108 B2
(45) Date of Patent: Sep. 29, 2009

(54) DIGITAL DATA BROADCASTING SYSTEMS, METHODS AND COMPONENTS THAT SELECTIVELY REBROADCAST DATA PACKETS BASED ON ANALYSIS OF PROPAGATION CHARACTERISTICS

(75) Inventors: George Ronald Olexa, Gainesville, GA (US); Hersh Raj Singh, Alexandria, VA (US)

(73) Assignee: Telcom Ventures, L.L.C., McLean, VA (US)

( * ) Notice: Subject to any disclaimer, the term of this patent is extended or adjusted under 35 U.S.C. 154(b) by 792 days.

(21) Appl. No.: 11/141,402

(22) Filed: May 31, 2005

(65) Prior Publication Data

US 2006/0268918 A1 Nov. 30, 2006

(51) Int. Cl.
*H04H 20/71* (2008.01)

(52) U.S. Cl. ..... 370/312; 370/270

(58) Field of Classification Search ..... 370/432, 370/390, 338, 349, 394, 231, 270, 312
See application file for complete search history.

(56) References Cited

U.S. PATENT DOCUMENTS 5,036,518 A * 7/1991 Tseung ..... 714/748
5,353,287 A * 10/1994 Kuddes et al. ..... 370/448
5,513,384 A * 4/1996 Brennan et al. ..... 455/180.1
5,732,357 A * 3/1998 Gayton et al. ..... 340/7.26
5,920,813 A 7/1999 Evans et al.
6,016,313 A 1/2000 Foster, Jr. et al.
6,128,483 A * 10/2000 Doiron et al. ..... 455/419
6,587,985 B1 * 7/2003 Fukushima et al. ..... 714/748
6,735,452 B1 5/2004 Foster, Jr. et al.
7,428,232 B2 * 9/2008 Park et al. ..... 370/349
2003/0137964 A1 * 7/2003 Suenaga et al. ..... 370/342
2003/0156573 A1 * 8/2003 Tran et al. ..... 370/349
2006/0203743 A1 * 9/2006 Quinn et al. ..... 370/254

* cited by examiner

*Primary Examiner*—Kwang B Yao
*Assistant Examiner*—Andrew Lai
(74) *Attorney, Agent, or Firm*—Myers Bigel Sibley & Sajovec, P.A.

(57) ABSTRACT

Digital data broadcasting is performed by analyzing propagation characteristics in a broadcast propagation area to determine a rebroadcasting strategy. Data packets are broadcast, and at least one of the data packets is selectively rebroadcast, to broadcast receiving stations in the broadcast propagation area according to the rebroadcasting strategy that was determined. The analyzing, broadcasting and selectively rebroadcasting are performed independent of receiving acknowledgements that data packets have or have not been received. The rebroadcasting strategy may be determined by measuring a received signal quality of broadcast data packets at multiple locations in the broadcast propagation area and/or by simulation of the propagation characteristics based on a model of the broadcast propagation area.

26 Claims, 8 Drawing Sheets

Basic Channel Structure

| | | | | | | | | | | | |
|---|---|---|---|---|---|---|---|---|---|---|---|
| Content Stream 1 | F 11 | F 12 | F 13 | F 14 | F 15 | | | | | | |
| Content Stream 2 | F 21 | F 22 | F 23 | F 24 | | | | | | | |
| Content Stream 3 | F 31 | F 32 | F 33 | F 34 | | | | | | | |
| ⋮ | ... | ... | ... | | | | | | | | |
| ⋮ | ... | ... | ... | | | | | | | | |
| Content Stream N | F N1 | F N2 | F N3 | F N4 | F N5 | | | | | | |

F = Frame Packet
X = Content Stream
Y = Frame Member

Convention:
FXY

FIG. 11

Basic Channel with Temporal Redundancy

| | | | | | | | | | | |
|---|---|---|---|---|---|---|---|---|---|---|
| Content Stream 1 | F 11 | F 12 | F 13 | F 14 | F 15 | F 11 | F 12 | F 13 | F 14 | F 15 |

FIG. 12

Basic Channel with Repeat

| | | | | | | | | | | | |
|---|---|---|---|---|---|---|---|---|---|---|---|
| Content Channel 1 | F 11 | F 11 | F 11 | F 12 | F 12 | F 12 | F 13 | F 13 | F 13 | F 14 | F 14 |

FIG. 13

DIGITAL DATA BROADCASTING SYSTEMS, METHODS AND COMPONENTS THAT SELECTIVELY REBROADCAST DATA PACKETS BASED ON ANALYSIS OF PROPAGATION CHARACTERISTICS

FIELD OF THE INVENTION

This invention relates to communications systems, methods and components, and more particularly to digital data broadcasting systems, methods and components.

BACKGROUND OF THE INVENTION

Digital data broadcasting systems, methods and components are presently used, and may be increasingly used in the future, to broadcast packets of digital data, such as digital multimedia data, to a large number of broadcast receiving stations in a broadcast propagation area. Digital data broadcasting systems, methods and components may be used, for example, to broadcast digital TV and/or digital radio signals to large numbers of digital TV/digital radio receiving stations. Digital data broadcasting also may be referred to as "datacasting". As used herein, "digital data broadcasting" and "datacasting" refer to one-way broadcasting wherein the broadcast receiving stations do not include a two-way capacity. Accordingly, the receiving stations are not capable of providing acknowledge/non-acknowledge (ACK/NACK) messages back to a transmitting station to indicate that a given data packet was or was not received.

SUMMARY OF THE INVENTION

Digital data broadcasting methods according to exemplary embodiments of the present invention analyze propagation characteristics in a broadcast propagation area, to determine a rebroadcasting strategy. Data packets are broadcast, and at least one of the data packets is selectively rebroadcast, to a plurality of broadcast receiving stations in the broadcast propagation area according to the rebroadcasting strategy that was determined. The analyzing, broadcasting and selectively rebroadcasting are performed independent of receiving acknowledgements that data packets have or have not been received. Moreover, in some embodiments, the analyzing is performed prior to the rebroadcasting.

In some embodiments, the propagation characteristics are analyzed by measuring received signal quality of broadcast data packets at a plurality of positions in the broadcast propagation area, and the rebroadcasting strategy is determined from the received signal quality that was measured. In some embodiments, the signal quality is indicated by a received signal strength indication, a bit error rate and/or a frame error rate of the broadcast data packets. In some embodiments, analyzing is performed by statistically analyzing samples of propagation characteristics in the broadcast propagation area, to determine the rebroadcasting rate. In yet other embodiments, the analyzing is performed by simulating or modeling the propagation characteristics in the broadcast propagation area. Combinations and subcombinations of these embodiments also may be provided. Moreover, in some embodiments the analyzing is performed prior to the broadcasting and prior to the rebroadcasting. As used herein, a "rebroadcasting strategy" includes a percentage of the data packets to be rebroadcast, a temporal displacement of rebroadcast data packets from corresponding broadcast data packets, a number or frequency of rebroadcasts of the broadcast data packets and/or other fixed and/or variable rebroadcasting parameters.

In other embodiments, subareas of the broadcast propagation area are identified, where propagation characteristics can be degraded. A number of the broadcast receiving stations that will be in the subareas is determined and time durations that the broadcast receiving stations will be in the subareas also are determined. The rebroadcasting strategy is then determined from the number and time durations of the broadcast receiving stations that will be in the degraded subareas.

In still other embodiments of the invention, the packets for rebroadcasting are selected based upon an importance of the digital data contained therein. For example, public service announcements or news broadcasts may be deemed of a higher importance than entertainment content. Then, the data packets are selectively rebroadcast based upon the importance of the digital data contained therein. In some embodiments of the present invention, selection of data packets for rebroadcasting based upon an importance of the digital data contained therein, may be performed independent of analyzing propagation characteristics in a broadcast propagation area to determine a rebroadcasting rate. The important data packets may be rebroadcast more often (i.e., a greater number of total repetitions) and/or at a higher frequency (i.e., at a higher rate of repetition) than unimportant data packets.

In some embodiments, the broadcasting and selectively rebroadcasting are performed simultaneously and/or alternatingly. Moreover, in some embodiments, a rebroadcast data packet is substituted for a broadcast data packet that was not received successfully at a respective broadcast receiving station. Moreover, a rebroadcast data packet may be discarded at the respective broadcast receiving station if a corresponding broadcast data packet was received successfully at the respective broadcast receiving station.

It will be understood by those having skill in the art that embodiments of the invention have been described above primarily with respect to digital data broadcasting methods. However, other embodiments of the present invention provide digital data broadcasting systems and components thereof, such as broadcast transmitting stations and broadcast receiving stations.

BRIEF DESCRIPTION OF THE DRAWINGS

FIGS. 11-15 illustrate broadcasting a series of data packets and rebroadcasting selected data packets according to other exemplary embodiments of the present invention.

DETAILED DESCRIPTION

Figure 1:
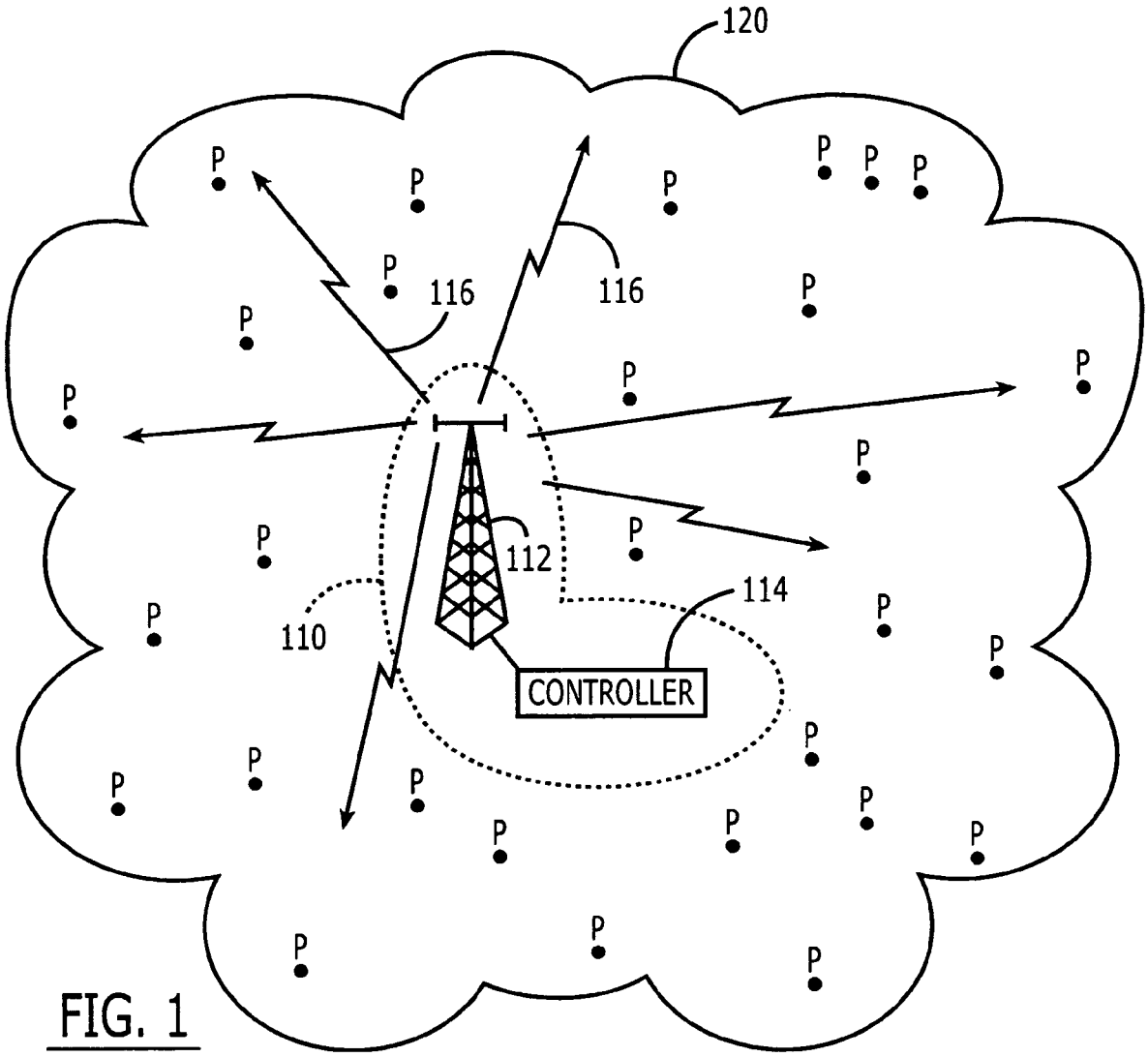
FIG. 1 is a schematic diagram of digital data broadcasting systems, methods and components according to exemplary embodiments of the present invention.

Embodiments of the present invention now will be described more fully hereinafter with reference to the accompanying drawings, in which embodiments of the invention are shown. This invention may, however, be embodied in many alternate forms and should not be construed as limited to the embodiments set forth herein. Rather, these embodiments are provided so that this disclosure will be thorough and complete, and will fully convey the scope of the invention to those skilled in the art.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like numbers refer to like elements throughout the description of the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. In contrast, the term "consisting of" when used in this specification, specifies the stated number of features, integers, steps, operations, elements, and/or components, and precludes additional features, integers, steps, operations, elements, and/or components. As used herein the term "and/or" includes any and all combinations of one or more of the associated listed items. The symbol "/" is also used as a shorthand notation for "and/or".

The present invention is described below with reference to block diagrams and/or flowchart illustrations of methods, apparatus (systems) and/or computer program products according to embodiments of the invention. It is understood that a block of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks. Accordingly, the present invention may be embodied in hardware and/or in software (including firmware, resident software, micro-code, etc.).

It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will also be understood that, although the terms first, second, etc. may be used herein to describe various elements, these elements should not be limited by these terms. These terms are only used to distinguish one element from another. For example, a first receiving station could be termed a second receiving station, and, similarly, a second receiving station could be termed a first receiving station without departing from the teachings of the disclosure.

FIG. 1 is a schematic diagram of digital data broadcasting systems, methods and components according to various exemplary embodiments of the present invention. As shown in FIG. 1, these digital data broadcasting systems, methods and components include a broadcast transmitting station 110 that includes a transmitter 112 and a controller 114. The broadcast transmitting station 110 is operable to broadcast data packets to a plurality of broadcast receiving stations (not shown in FIG. 1) in a broadcast propagation area 120, also referred to as a "footprint" or "coverage area". Although a single digital data broadcast transmitting station 110 is illustrated in FIG. 1, more than one transmitting station 110 may be used to enlarge the footprint 120. The controller 114 and the transmitter 112 may be co-located, partially co-located or positioned at geographically separates sites. Moreover, a single controller 114 may be used with multiple transmitters 112 and/or multiple controllers 114 may be used with a single transmitter 112. As shown in FIG. 1, the transmitting station 110 is a one-way broadcast transmitting station 110 that does not receive feedback from broadcast receiving stations, so that, at a given point in time, the transmitting station controller 114 does not have knowledge of whether a given packet was or was not received successfully and at which receiving stations the given packet was or was not received successfully.

Figure 2:
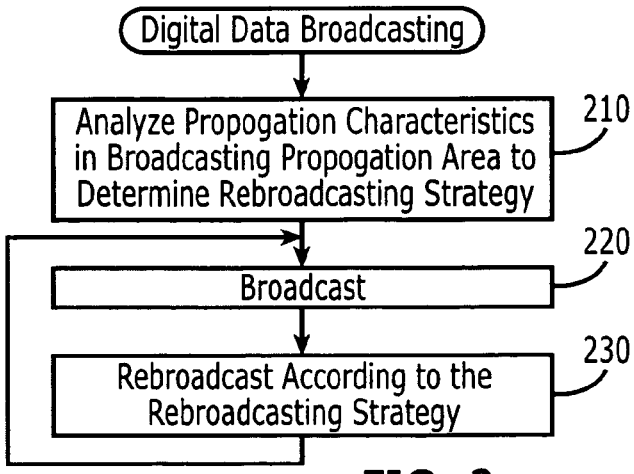
FIG. 2 is a flowchart of digital data broadcasting operations that may be performed according to exemplary embodiments of the present invention.

FIG. 2 is a flowchart of digital data broadcasting operations that may be performed, according to exemplary embodiments of the present invention. These operations may be performed, at least in part, by the controller 114 of FIG. 1 and/or by other data processors. Moreover, at least some of the operations may be performed manually and/or separate from the controller 114.

More specifically, referring to FIG. 2, at Block 210, the propagation characteristics in the broadcast propagation area 120 are analyzed to determine a rebroadcasting strategy. As used herein, a "rebroadcasting strategy" includes a percentage of the data packets to be rebroadcast, a temporal displacement of rebroadcast data packets from corresponding broadcast data packets, a number or frequency of rebroadcasts of the broadcast data packets and/or other fixed and/or variable rebroadcasting parameters. At Block 220, data packets are broadcast to a plurality of broadcast receiving stations in the broadcast propagation area 120. Moreover, at Block 230, at least one of the data packets is selectively rebroadcast to the plurality of broadcast receiving stations in the broadcast propagation area according to the rebroadcasting strategy that was determined. The operations of Blocks 220 and 230 may be repeated for the duration of the broadcasting. The analyzing, broadcasting and selectively rebroadcasting operations of Blocks 210, 220 and 230, respectively, are performed independent of receiving acknowledgments, for example, from the broadcast receiving stations 310, that packets have or have not been received.

Still referring to FIGS. 1 and 2, in some embodiments, the analyzing of Block 210 is performed by measuring received signal quality of broadcast data packets at a plurality of positions P in the broadcast propagation area 120. The positions P may be determined randomly and/or by a priori knowledge of where it is likely that broadcasting reception quality may suffer. The rebroadcasting strategy may be determined at Block 210 from the received signal quality that was measured at the plurality of positions P. It will be understood by those having skill in the art that received signal quality can be measured using many conventional techniques, including received signal strength indications, bit error rates, frame error rates and/or other conventional techniques. The received signal qualities that were measured at the various positions P may be analyzed statistically in terms of the locations of the positions P, in order to determine a rebroadcasting strategy at Block 210. In other embodiments, the broadcasting propagation area may be simulated (modeled) from a topological and/or structural perspective, to simulate areas that may cause low quality reception, without the need to perform measurements. Moreover, in other embodiments, simulations and measurements may both be performed and the results thereof may be combined to obtain a rebroadcasting strategy.

Figure 3:
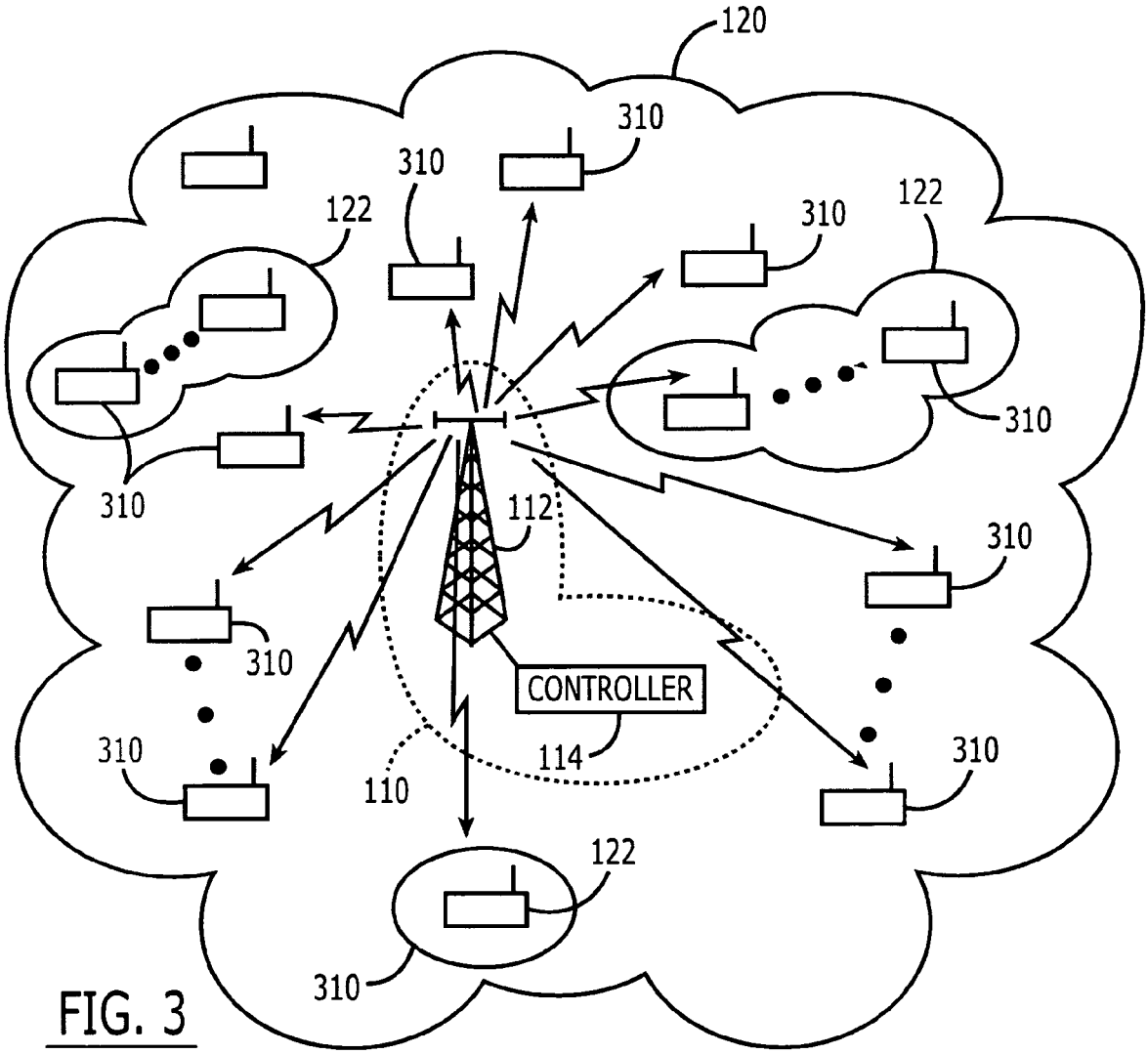
FIG. 3 is a schematic diagram of digital data broadcasting systems, methods and components according to other exemplary embodiments of the present invention.

FIG. 3 is a schematic diagram of digital data broadcasting systems, methods and components, according to other exemplary embodiments of the present invention. In these embodiments, analyzing the propagation characteristics in the broadcast propagation area 120 may be performed by identifying subareas 122 of the broadcast propagation area 120, where propagation characteristics can be degraded. These subareas 122 may correspond to natural features, such as mountains, and/or manmade features, such as tunnels, overpasses, buildings, etc. Moreover, a number of broadcast receiving stations 310 that will be in the identified subareas 122 may be determined and, where the broadcast receiving stations 310 are mobile, the time durations that the broadcast receiving stations 310 will be in the subareas 122 also may be determined. As was the case with embodiments of FIG. 1, the identification of the subareas, the determination of the number of broadcast receiving stations, and the determination of time durations may be performed by performing measurements and/or by performing simulations.

Accordingly, some embodiments of the present invention as illustrated in FIGS. 1-3 statistically analyze samples of propagation characteristics (measured and/or simulated) in the broadcast propagation area 120, to determine the rebroadcasting strategy. It also will be understood that operations of Block 210 may be performed repeatedly prior to deployment and/or after deployment of the digital data broadcasting system, to provide a rebroadcasting strategy that changes over time. Finally, it also will be understood that when a digital broadcasting system includes multiple transmitters 112, the rebroadcasting strategy may vary among the various transmitters based upon the characteristics of the area covered by a given transmitter. Thus, when multiple transmitters are present, all of the transmitters need not employ the same rebroadcasting strategy.

Figure 4:
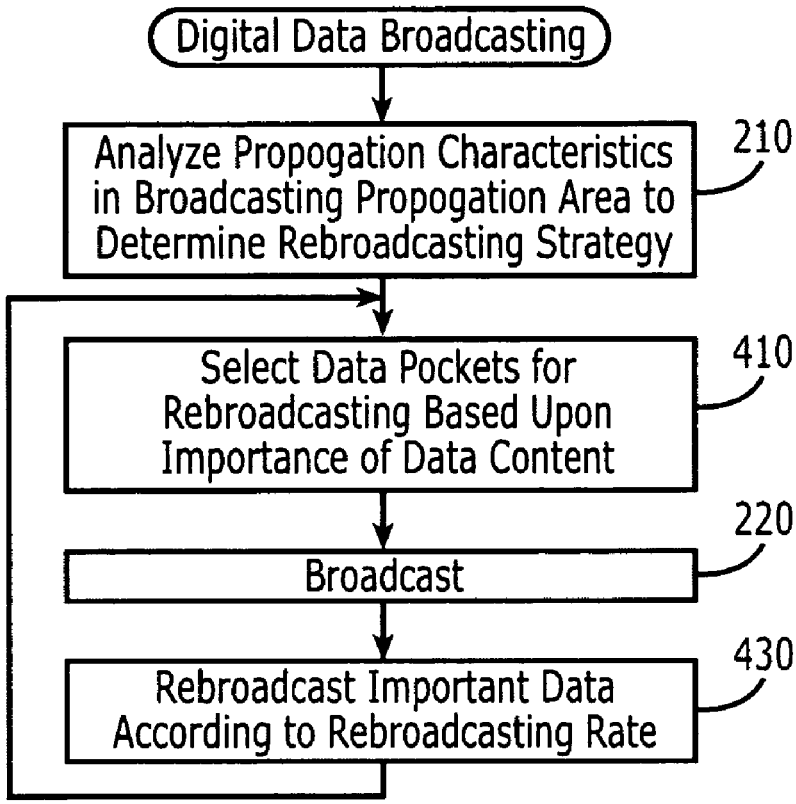
FIGS. 4 and 5 are flowcharts of operations that may be performed according to other exemplary embodiments of the present invention.

FIG. 4 illustrates other embodiments of the present invention. Propagation characteristics are analyzed at Block 210 as was described above. However, in these embodiments, at Block 410, the data packets for rebroadcasting are selected based upon an importance of the data content, i.e., the importance of the digital data contained in the packets. Thus, for example, packets that contain emergency broadcast messages, e.g., for first responders, may have a higher importance than entertainment content. Packets are broadcast at Block 220, and at Block 430, the important data is rebroadcast according to the rebroadcasting strategy determined at Block 210. It will be understood that not all of the important data may be rebroadcast and/or some of the less important data also may be broadcast, depending upon the amount of data that is classified as important and the rebroadcasting strategy. Accordingly, rebroadcasting may be based on the importance of the data content, as well as the propagation characteristics in the broadcast propagation area.

In yet other embodiments of the present invention, the data packets for rebroadcasting may be selected based on the demographics of the area and/or the targeted demographics of the content. For example, a channel dedicated to specific ethnic content could have retransmission tailored to improve performance in areas containing a significant concentration of that ethnic population. In one specific example, a channel focused on Polish content may have retransmission adjusted to improve delivery in Conshohocken, Pa., since this area contains a high percentage of Polish immigrants and their families. These embodiments may be combined with any or all of the other embodiments of the present invention.

Figure 5:
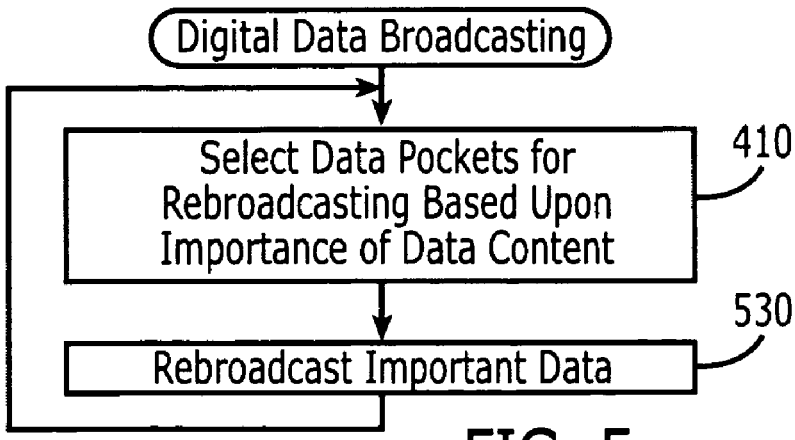

FIG. 5 illustrates yet other embodiments of the present invention wherein data packets for rebroadcasting are selected based upon the importance of the data content, independent of analyzing the propagation characteristics in the broadcast propagation area. Thus, at Block 530, at least one of a series of data packets that was broadcast to a plurality of broadcast receiving stations in the broadcast propagation area is selectively rebroadcast based upon an importance of the data that was contained therein. In some embodiments, important data packets are broadcast more often and/or at a higher frequency (repetition rate) than unimportant data packets. It will also be understood by those having skill in the art that, as used herein, the terms "important" and "unimportant" are relative terms, and that various fixed and/or variable levels of importance may be assigned based upon the content of the digital data.

Figure 6:
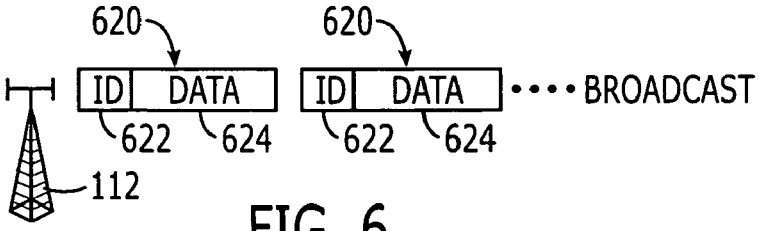
FIGS. 6-8 are block diagrams that illustrate broadcasting a series of data packets and rebroadcasting selected data packets according to exemplary embodiments of the present invention.

FIG. 6 is a block diagram that illustrates broadcasting data packets to a plurality of broadcast receiving stations 310 in the broadcast propagation area 120, according to exemplary embodiments of the present invention. As shown in FIG. 6, a respective data packet 620 includes a respective packet identification (ID) 622 and corresponding packet data 624. Packet transmissions of data, including packet headers that have identifications, are well known to those having skill in the art and need not be described further herein. Indeed, embodiments of the present invention can use a conventional packet transmission protocol, such as Internet Protocol (IP) and/or Asynchronous Transfer Mode (ATM) protocol, or simplified versions thereof, to transmit the data packets 620, including packet identification 622, to the plurality of broadcast receiving stations 310 in the broadcast propagation area 120. Moreover, data protocols that are developed in the future also may be used in various embodiments of the present invention.

Figure 7:
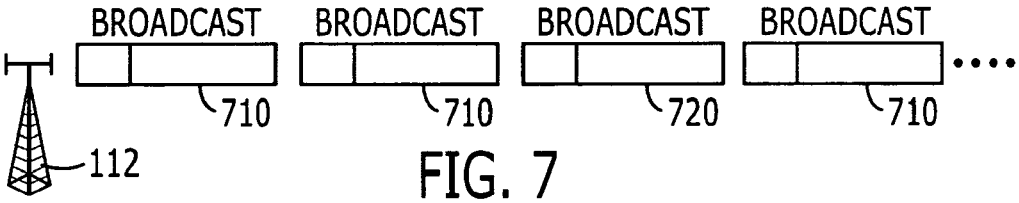

Many different techniques may be used by the broadcast transmitting station 110 to broadcast and selectively rebroadcast data packets. For example, in FIG. 7, a transmitter, such as the transmitter 112 of FIGS. 1 and 3, is operable to alternatingly broadcast data packets 710 and rebroadcast data packets 720 to the plurality of broadcast receiving stations in the broadcast propagation area according to the rebroadcasting strategy that was determined. Thus, in embodiments of FIG. 7, when the controller 114 determines that a packet should be rebroadcast, the rebroadcast packet 720 may be inserted into the broadcast data stream. Transmission of broadcast packets 710 may then resume. Accordingly, alternating transmission of broadcast packets 710 and rebroadcast packets 720 may occur using equal and/or unequal numbers of broadcast and rebroadcast packets. Moreover, the ratio of rebroadcast to broadcast packets may vary dramatically depending on the rebroadcasting strategy that is determined or redetermined. However, in embodiments of FIG. 7, the alternating broadcast and rebroadcast of data packets may take place over the entire bandwidth of the digital data broadcasting system.

Figure 8:
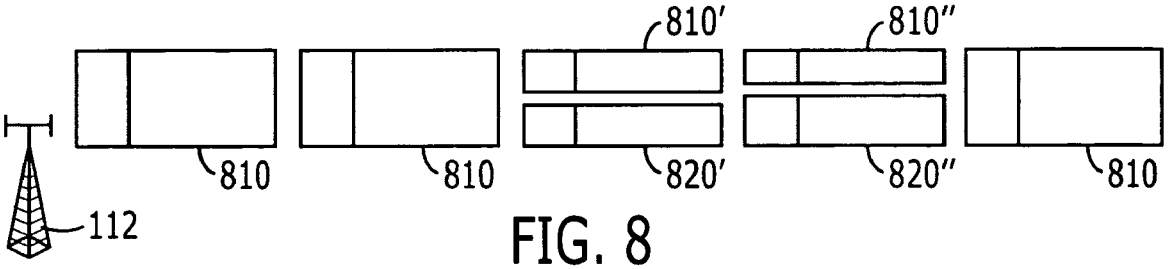

In contrast, as shown in FIG. 8, the bandwidth of the digital data broadcasting system may be shared among the broadcast and rebroadcast data packets, so that the transmitter, such as the transmitter 112 of FIGS. 1 and 3, is operable to simultaneously broadcast data packets and rebroadcast data packets over the digital data broadcasting frequencies to the plurality of broadcast receiving stations 310 in the broadcast propagation area 120. Thus, as shown in FIG. 8, when no rebroadcast data packets need be transmitted, the entire bandwidth may be used for broadcast data packets 810. However, when it is deemed desirable to rebroadcast data packets, the bandwidth may be shared among reduced bandwidth broadcast packets 810' and rebroadcast packets 820'. Moreover, the amount of bandwidth that is used for broadcast packets 810 and rebroadcast packets 820 may be varied, as indicated by the relative thicknesses of the broadcast packets 810' and 810", and the rebroadcast packets 820' and 820", in FIG. 8. Variable relative bandwidths may thereby be used to simultaneously broadcast data packets and rebroadcast data packets over digital data broadcast frequencies, according to some embodiments of the invention. It also will be understood that embodiments of FIGS. 7 and 8 may be combined.

Figure 9:
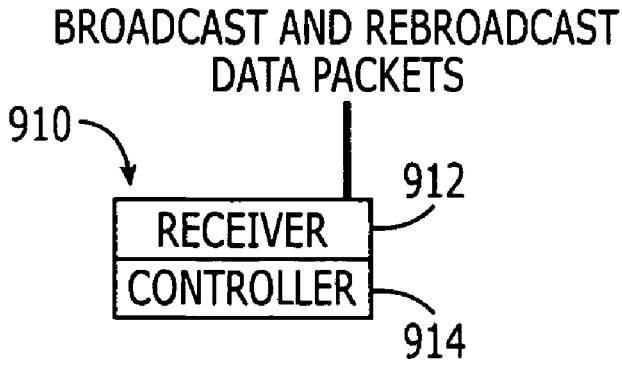
FIG. 9 is a block diagram of a broadcast receiving station according to exemplary embodiments of the present invention.

FIG. 9 is a block diagram of a broadcast receiving station 910 according to some embodiments of the invention. The broadcast receiving station 910 may correspond to the broadcast receiving stations 310 of FIG. 3. As shown in FIG. 9, the broadcast receiving station 910 includes a receiving station receiver 912 and a receiving station controller 914. The receiving station receiver 912 is responsive to a transmitting station 110, and is operable to receive broadcast and rebroadcast data packets. The controller 914 is responsive to the broadcast data packets and the rebroadcast data packets that are received, and is operable to substitute a rebroadcast data packet for a broadcast data packet that was not received successfully at the receiver 912. The controller 914 may also be operable to discard a rebroadcast data packet when a corresponding broadcast data packet was received successfully at the receiver 912.

Figure 10:
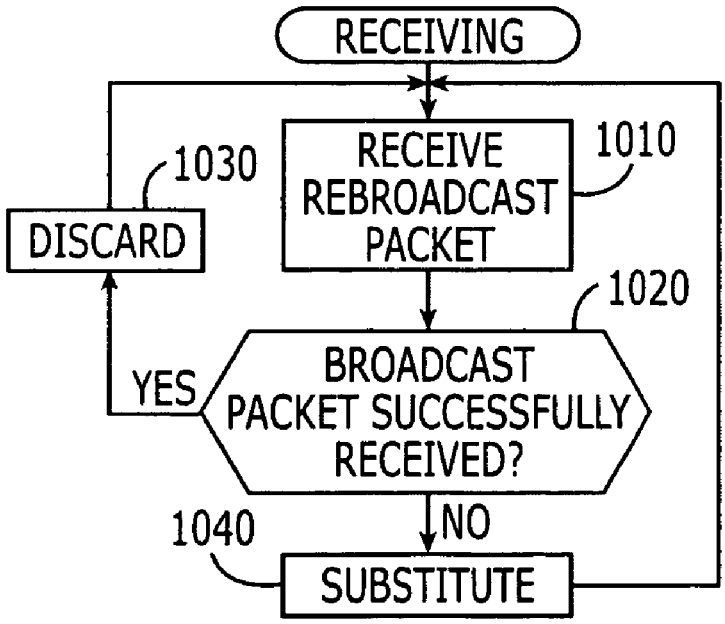
FIG. 10 is a flowchart of operations that may be performed for receiving digital data broadcasts according to exemplary embodiments of the present invention.
Figure 14:
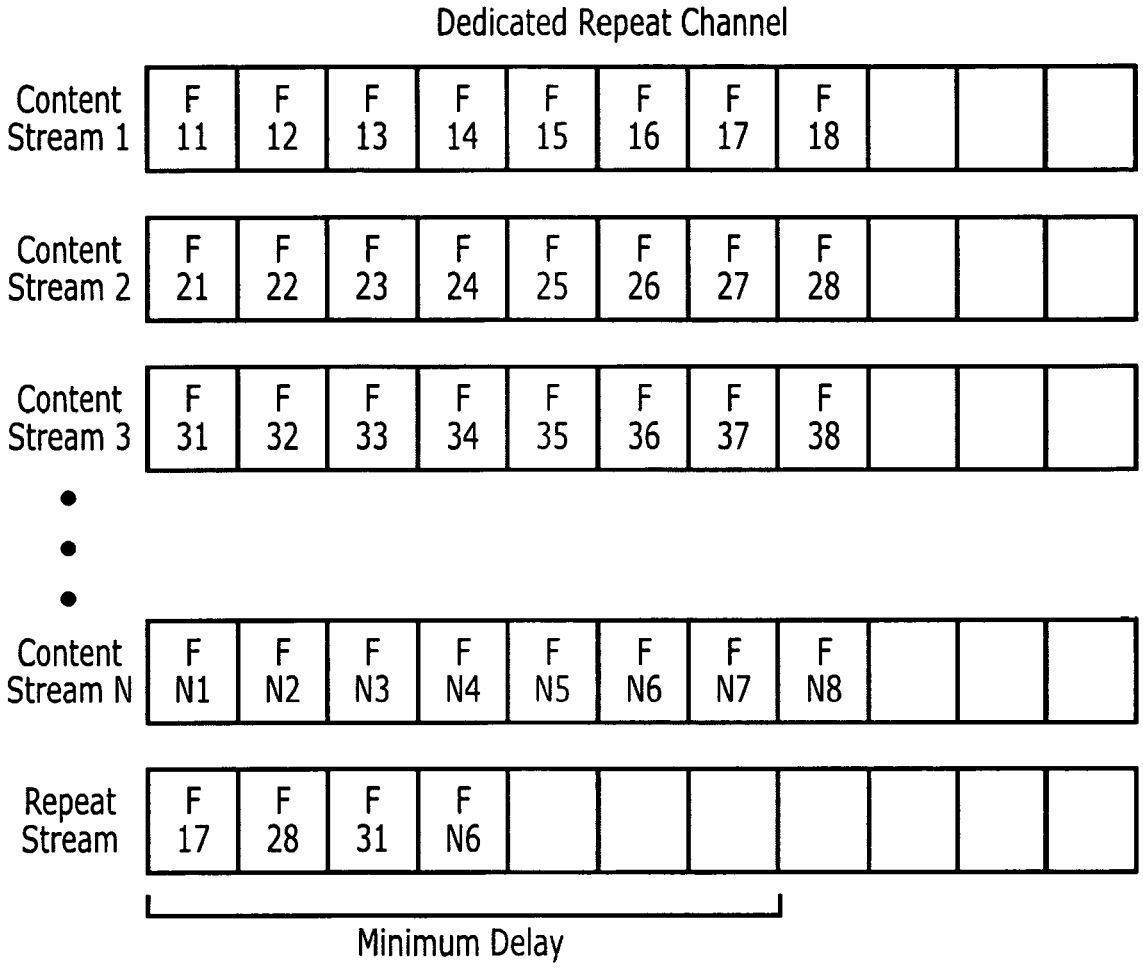

FIG. 10 is a flowchart of operations that may be performed to receive broadcast data packets according to various embodiments of the present invention. These operations may be performed, for example, by receiving stations 310 and/or 910 of FIGS. 3 and 9, respectively. In particular, at Block 1010, a rebroadcast packet is received. At Block 1020, a determination is made as to whether the corresponding broadcast packet was successfully received. If yes, then the rebroadcast packet is discarded at Block 1030, and if not, then the rebroadcast packet is substituted for the corresponding broadcast packet at Block 1040. As used herein, substituting a rebroadcast data packet for the corresponding broadcast data packet also includes processing both the rebroadcast data packet and the corresponding broadcast data packet, to more effectively detect the data therein.

Additional discussion of various embodiments of the present invention now will be provided. Embodiments of the invention can improve and/or assure message delivery to remote broadcast receiving stations in a network providing one-way datacasting or broadcasting services. In addition, embodiments of the invention can retransmit errored data to all receiving stations in cases where high error rates are known to exist. Moreover, embodiments of the invention can include capabilities at the receiving station that are able to identify this redundant transmission and determine whether it is appropriate to keep or discard the redundant information.

Exemplary embodiments of the invention do not require broadcast receiving stations to include a two-way capability, as would be present in a traditional ACK/NACK system. Moreover, exemplary embodiments of the invention do not need complete knowledge about the error conditions at every receiving station, but instead can utilize a statistical analysis based upon known or expected propagation conditions in the covered area to make determinations of what actions should be taken to improve the receive error rates experienced by the receiving stations, and thus can increase the link margin or error free information delivery at a statistically significant number of receiving stations being served by the transmitting station.

In some embodiments, the coverage area of the transmitting station may be characterized by field testing and/or propagation analysis to determine the reliability of the service contour. Characteristics of the signal (such as received signal strength indication, bit error rate, frame error rate, etc.) may be characterized as a baseline. This baseline may be used as the basis for average behavior of the area, and can characterize the average propagation losses associated with the path between the transmitting station(s) and receiving station(s).

The broadcasting system and system protocols may set aside a fixed and/or variable percentage of bandwidth to be used for sending this redundant information when necessary or desirable, and/or may use the entire channel, or a portion of the channel "on the fly" as necessary or desirable to retransmit the lost information. The selection of retransmit methodology may be based upon the needs of the system, and/or the amount of buffering in the receiving stations or overhead available in the channel.

Exemplary embodiments of the invention can force the retransmission of data and allow the individual receiving stations to determine and discard the redundant data, while keeping any missing data. There is a statistical probability that some receiving stations will receive an error free communication. Thus, receiving stations in the system can have the ability to monitor the incoming communication and can have the ability to identify retransmitted information. If the retransmitted information is redundant to that already received, then the receiving station can select the least errored copy and discard the redundant information. This will allow uninterrupted flow of information with fewer or no errors occurring due to the repeated information.

Accordingly, exemplary embodiments of the present invention can allow the network to be designed with lower path availability while still allowing the system to deliver high apparent availability to the users of the system. The system coverage can be significantly increased, since the system radio frequency link design margins can be significantly decreased. Moreover, larger link distances may be covered, since it may be assumed that local shadowing or other impairments leading to signal fades are a geographically isolated, low order statistical event, and in the instance that local conditions affect the link, the system can accommodate these local conditions and maintain apparent availability.

Embodiments of the invention may be used with wireless and/or wired broadcasting or datacasting. In an exemplary wireless one-way system, such as a digital broadcast or datacast system, there will be areas within the desired coverage area that exhibit weak coverage. These weak areas could be caused by terrain shadowing, attenuation due to morphology (buildings and trees) and/or due to the receiving station being operated inside a structure that attenuates the radio signal. Under these weak signal conditions, the receiving stations may no longer be receiving sufficient signal strength to assure complete reception of the information being sent.

The desired coverage area of the transmitting station may be characterized by field testing the signal strength and receiver performance at a large number of locations. Using this information, the location and duration of outages can be understood. The location and duration information may be overlaid on expected user behavior, such as the expected percentage of users who are located or moving through in these weak areas and/or the frequency and duration of their presence in the weak areas. The statistics of user behavior and the distribution of weak coverage areas may be used to determine the amount of information that should be retransmitted, and/or the temporal displacement and frequency (i.e., number of retransmissions) of these retransmissions, to thereby determine a rebroadcasting strategy.

In some embodiments, the retransmission interval and/or the amount of information to be retransmitted can be variable, and can be changed to accommodate the criticality (importance) of the information. For example, critical information, such as public safety related information, might be resent many more times and/or more frequently in order to assure that this tactically critical information is received by those first responders who need the information. Other information of a less critical nature could be sent with a lower retransmission priority and/or frequency.

As was described above, the retransmission of information could take place on a dedicated retransmission channel (a physical and/or a logical channel) and/or it could be interleaved with the main content. Embodiments of the invention can identify the main and retransmitted information, and the receiving stations can correctly reassemble the information stream by choosing the main and retransmitted content to reconstruct the information being disseminated.

Figure 15:
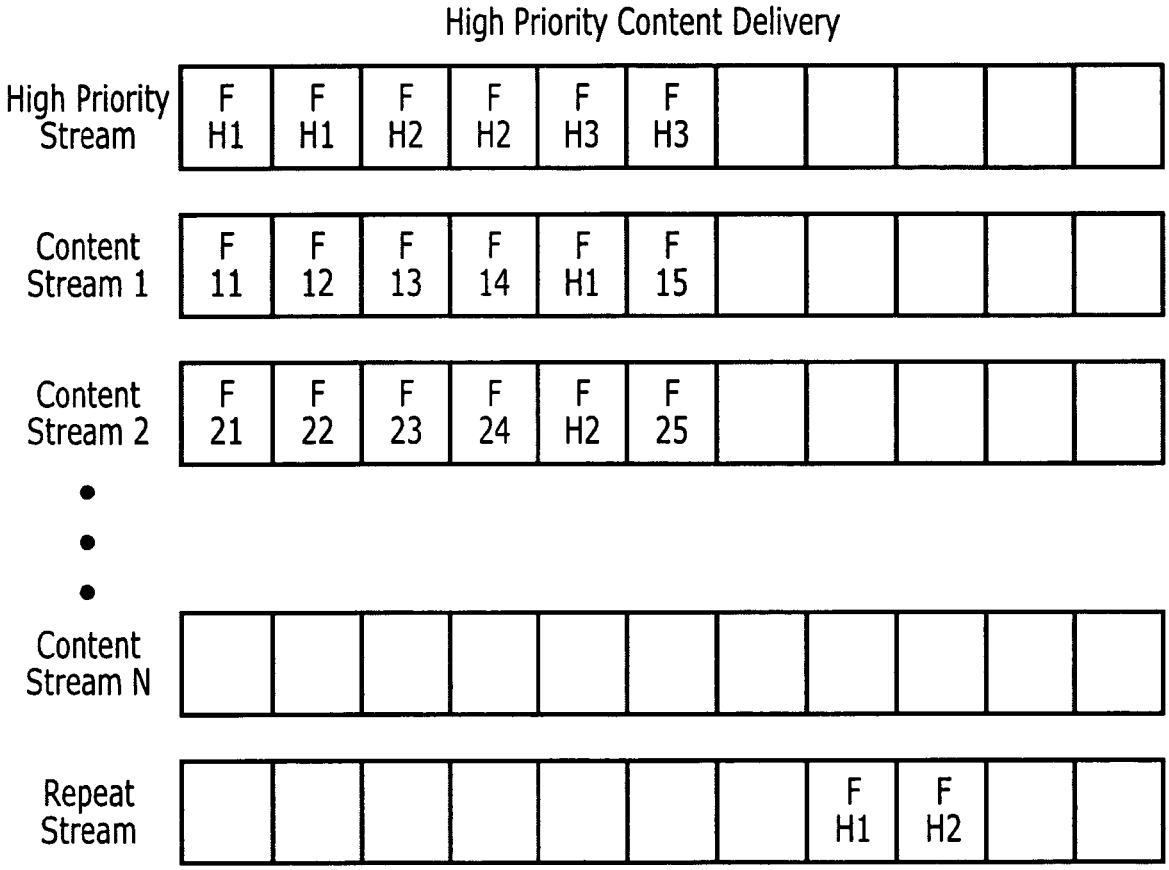

FIGS. 11 through 15 show various exemplary embodiments for placing the main (broadcast) and retransmitted (rebroadcast) content into the broadcast or datacast stream. Each embodiment may be used individually, or combined with one or more other embodiments. The selection of the appropriate retransmission embodiment may be based upon the propagation anomalies in the coverage area. FIG. 11 illustrates a basic channel structure according to exemplary embodiments of the invention. Numerous extremely short duration outages may be better suited to embodiments of FIG. 13 wherein a basic channel with repeat is provided. Medium term outages may be better served by embodiments of FIG. 12 wherein lower frequency temporal redundancy is provided. Finally, long duration outages may be better served by embodiments of FIG. 12 or FIG. 14 wherein a dedicated repeat channel is provided. The selection of repeat timing and interval may be based upon the duration of the outages measured in the coverage area. An exemplary embodiment of high importance content delivery is illustrated in FIG. 15.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A digital data broadcasting method comprising:

analyzing propagation characteristics in a broadcast propagation area to determine a rebroadcasting strategy;

broadcasting data packets to a plurality of broadcast receiving stations in the broadcast propagation area; and selectively rebroadcasting at least one of the data packets to the plurality of broadcast receiving stations in the broadcast propagation area according to the rebroadcasting strategy that was determined;

wherein analyzing, broadcasting and selectively rebroadcasting are performed independent of receiving acknowledgments that data packets have or have not been received.

2. A method according to claim 1 wherein analyzing comprises:

measuring received signal quality of broadcast data packets at a plurality of positions in the broadcast propagation area; and determining the rebroadcasting strategy from the received signal quality that was measured.

3. A method according to claim 1 wherein analyzing comprises:

identifying subareas of the broadcast propagation area where propagation characteristics can be degraded;

determining a number of the broadcast receiving stations that will be in the subareas;

determining time durations that the broadcast receiving stations will be in the subareas; and determining the rebroadcasting strategy from the number and time durations that the broadcast receiving stations that will be in the subareas.

4. A method according to claim 3 further comprising:

determining a temporal displacement of the rebroadcast data packets from corresponding broadcast data packets and/or a number of rebroadcasts of the rebroadcast data packets from the number and time durations that the broadcast receiving stations that will be in the subareas.

5. A method according to claim 1 wherein the rebroadcasting strategy comprises a percentage of data packets to be rebroadcast, a temporal displacement of rebroadcast data packets from corresponding broadcast data packets and/or a number of rebroadcasts of the broadcast data packets.

6. A method according to claim 1 wherein analyzing comprises statistically analyzing samples of propagation characteristics in the broadcast propagation area to determine the rebroadcasting strategy.

7. A method according to claim 1 wherein analyzing comprises simulating the propagation characteristics in the broadcast propagation area to determine the rebroadcasting strategy.

8. A method according to claim 1 wherein analyzing is performed prior to broadcasting and prior to selectively rebroadcasting.

9. A method according to claim 1 further comprising:

selecting the data packets for rebroadcasting based upon an importance of the digital data contained therein; and wherein selectively rebroadcasting comprises selectively rebroadcasting the data packets that were selected based upon the importance of the digital data contained therein.

10. A method according to claim 2 wherein measuring received signal quality comprises measuring a received signal strength indication, a bit error rate and/or a frame error rate of the broadcast data packets at the plurality of positions in the broadcast propagation area.

11. A method according to claim 1 wherein broadcasting data packets and selectively rebroadcasting at least one of the data packets are performed simultaneously and/or alternatingly.

12. A method according to claim 1 further comprising:

substituting a rebroadcast data packet for a broadcast data packet that was not received successfully at a respective broadcast receiving station in the broadcast propagation area; and discarding a rebroadcast data packet if a corresponding broadcast data packet was received successfully at the respective broadcast receiving station in the broadcast propagation area.

13. A digital data broadcasting system comprising:

means for analyzing propagation characteristics in a broadcast propagation area to determine a rebroadcasting strategy;

means for broadcasting data packets to a plurality of broadcast receiving stations in the broadcast propagation area; and means for selectively rebroadcasting at least one of the data packets to the plurality of broadcast receiving stations in the broadcast propagation area according to the rebroadcasting strategy that was determined;

wherein the means for analyzing, broadcasting and selectively rebroadcasting operate independent of receiving acknowledgments that data packets have or have not been received.

14. A system according to claim 13 wherein the means for analyzing comprises:

means for measuring received signal quality of broadcast data packets at a plurality of positions in the broadcast propagation area; and means for determining the rebroadcasting strategy from the received signal quality that was measured.

15. A system according to claim 13 wherein the means for analyzing comprises:

means for identifying subareas of the broadcast propagation area where propagation characteristics can be degraded;

means for determining a number of the broadcast receiving stations that will be in the subareas;

means for determining time durations that the broadcast receiving stations will be in the subareas; and means for determining the rebroadcasting strategy from the number and time durations that the broadcast receiving stations that will be in the subareas.

16. A system according to claim 15 further comprising:

means for determining a temporal displacement of the rebroadcast data packets from corresponding broadcast data packets and/or a number of rebroadcasts of the rebroadcast data packets from the number and time durations that the broadcast receiving stations that will be in the subareas.

17. A system according to claim 13 wherein the rebroadcasting strategy comprises a percentage of data packets to be rebroadcast, a temporal displacement of rebroadcast data packets from corresponding broadcast data packets and/or a number of rebroadcasts of the broadcast data packets.

18. A system according to claim 13 wherein the means for analyzing comprises means for statistically analyzing samples of propagation characteristics in the broadcast propagation area to determine the rebroadcasting strategy.

19. A system according to claim 13 wherein the means for analyzing comprises means for simulating the propagation characteristics in the broadcast propagation area to determine the rebroadcasting strategy.

20. A system according to claim 13 wherein the means for analyzing operates prior to the means for broadcasting and the means for selectively rebroadcasting.

21. A system according to claim 13 further comprising:

means for selecting the data packets for rebroadcasting based upon an importance of the digital data contained therein; and wherein the means for selectively rebroadcasting comprises means for selectively rebroadcasting the data packets that were selected based upon the importance of the digital data contained therein.

22. A system according to claim 14 wherein the means for measuring received signal quality comprises means for measuring a received signal strength indication, a bit error rate and/or a frame error rate of the broadcast data packets at the plurality of positions in the broadcast propagation area.

23. A system according to claim 13 wherein the means for broadcasting data packets and the means for selectively rebroadcasting at least one of the data packets operate simultaneously and/or alternatingly.

24. A system according to claim 13 further comprising:

means for substituting a rebroadcast data packet for a broadcast data packet that was not received successfully at a respective broadcast receiving station in the broadcast propagation area; and means for discarding a rebroadcast data packet if a corresponding broadcast data packet was received successfully at the respective broadcast receiving station in the broadcast propagation area.

25. A digital data broadcast transmitting station comprising:

a transmitter that is configured to broadcast data packets to a plurality of broadcast receiving stations in a broadcast propagation area; and a controller that is configured to control the transmitter to selectively rebroadcast at least one of the data packets to the plurality of broadcast receiving stations in the broadcast propagation area independent of receiving acknowledgments that data packets have or have not been received, according to a rebroadcasting strategy that is based upon analysis of propagation characteristics in the broadcast propagation area.

26. A transmitting station according to claim 25 wherein the controller is further configured to select the data packets for rebroadcasting based upon an importance of the digital data contained therein, and to control the transmitter to selectively rebroadcast the data packets that were selected based upon the importance of the digital data contained therein.

* * * * *